US011143217B2

(12) United States Patent
Fukuda

(10) Patent No.: US 11,143,217 B2
(45) Date of Patent: Oct. 12, 2021

(54) HYDRAULIC SYSTEM FOR WORKING MACHINE

(71) Applicant: KUBOTA CORPORATION, Osaka (JP)

(72) Inventor: Yuji Fukuda, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 128 days.

(21) Appl. No.: 16/448,592

(22) Filed: Jun. 21, 2019

(65) Prior Publication Data

US 2020/0002921 A1 Jan. 2, 2020

(30) Foreign Application Priority Data

Jun. 27, 2018 (JP) ..... JP2018-122399

(51) Int. Cl.
*F15B 21/0427* (2019.01)
*E02F 9/22* (2006.01)
(Continued)

(52) U.S. Cl.
CPC ..... *F15B 21/0427* (2019.01); *E02F 9/2267* (2013.01); *E02F 9/2285* (2013.01);
(Continued)

(58) Field of Classification Search
CPC ..... F15B 21/0427; F15B 2211/635; F15B 2211/6355; F15B 2211/7135;
(Continued)

(56) References Cited

U.S. PATENT DOCUMENTS 7,743,611 B2 * 6/2010 Horii ..... E02F 9/2296 60/421
8,516,805 B2 * 8/2013 Hagiwara ..... E02F 9/2285 60/295
(Continued)

FOREIGN PATENT DOCUMENTS

JP S61-022903 U1 2/1986
JP H2-145304 U1 12/1990
(Continued)

*Primary Examiner* — Dustin T Nguyen
(74) *Attorney, Agent, or Firm* — Greenblum & Bernstein, P.L.C.

(57) ABSTRACT

A hydraulic system includes a hydraulic pump, an output fluid tube connected to the hydraulic pump, an operation fluid tube connected to a hydraulic device, an unload valve connected to the output fluid tube, and having: a supply position in which the operation fluid in the output fluid tube is supplied to the operation fluid tube; and a restrain position in which supply of the operation fluid to the operation fluid tube is restrained, an operation valve connected to the output fluid tube, a control fluid tube connecting the operation valve and the hydraulic device, a warmup fluid tube connecting the control fluid tube and the operation fluid tube, and a check valve provided in the warm-up fluid tube and being for allowing the operation fluid to flow from the control fluid tube side toward the operation fluid tube, and for blocking the operation fluid from flowing side from the operation fluid tube toward the control fluid tube.

6 Claims, 3 Drawing Sheets

(51) Int. Cl.

| | |
|---|---|
| ***F15B 11/042*** | (2006.01) |
| *E02F 9/02* | (2006.01) |
| *F15B 11/10* | (2006.01) |

(52) U.S. Cl.

CPC ..... *F15B 11/042* (2013.01); *E02F 9/02* (2013.01); *E02F 9/2225* (2013.01); *E02F 9/2275* (2013.01); *E02F 9/2292* (2013.01); *E02F 9/2296* (2013.01); *F15B 11/10* (2013.01); *F15B 2211/411* (2013.01); *F15B 2211/62* (2013.01); *F15B 2211/6355* (2013.01); *F15B 2211/66* (2013.01); *F15B 2211/6658* (2013.01); *F15B 2211/7058* (2013.01); *F15B 2211/7135* (2013.01); *F15B 2211/75* (2013.01)

(58) Field of Classification Search

CPC ..... F15B 2211/66; F15B 2211/6658; F15B 2211/62; F15B 2211/411; F15B 2211/7058; F15B 2211/75; F15B 2211/355; F15B 2211/6346; F15B 2211/6343; F15B 2211/67; F15B 2211/20538; F15B 2211/7142; F15B 2211/329; F15B 2211/30595; F15B 2211/20546; F15B 2211/20576; E02F 9/2285; E02F 9/2267; E02F 9/2275

See application file for complete search history.

(56) References Cited

U.S. PATENT DOCUMENTS

| | | | | |
|---|---|---|---|---|
| 8,948,983 | B2 * | 2/2015 | Horii | E02F 9/22 701/50 |
| 9,328,757 | B2 * | 5/2016 | Horii | E02F 9/2285 |
| 10,562,505 | B2 * | 2/2020 | Hafvenstein | B60T 17/221 |
| 10,711,437 | B2 * | 7/2020 | Nishiguchi | F15B 13/0433 |
| 10,941,793 | B2 * | 3/2021 | Fukuda | E02F 9/2271 |
| 10,975,893 | B2 * | 4/2021 | Fukuda | F15B 13/029 |
| 11,001,990 | B2 * | 5/2021 | Fukuda | E02F 9/2275 |
| 2014/0193230 | A1 * | 7/2014 | McWethy | F15B 21/0427 414/680 |
| 2021/0148386 | A1 * | 5/2021 | Fukuda | E02F 9/2004 |

FOREIGN PATENT DOCUMENTS

| | | |
|---|---|---|
| JP | 2010270527 | 12/2010 |
| JP | 5586543 | 9/2014 |

* cited by examiner

HYDRAULIC SYSTEM FOR WORKING MACHINE

CROSS-REFERENCE TO RELATED APPLICATIONS

The present application claims priority under 35 U.S.C. § 119 to Japanese Patent Application No. 2018-122399, filed Jun. 27, 2018. The content of this application is incorporated herein by reference in their entirety.

BACKGROUND OF THE INVENTION

Field of the Invention

The present invention relates to hydraulic systems in backhoes and other work machines.

Description of Related Art

An example of a conventional work machine is the backhoe according to Japanese Pat. No. 5,586,543.

The backhoe of Japanese Pat. No. 5,586,543 is furnished with pilot-switching valves for the hydraulic actuators; with remote control valves; with pilot-pump fluid tubes along which operation fluid from the pilot pump's discharge circuit is supplied to the remote control valves; and with unload valves that can switch between a supply position where the discharge circuit is coupled to the start end of the pilot-pump fluid tubes, and an unload position where the coupling between the discharge circuit and the pilot-pump fluid tubes is shut off; wherein a warming circuit is provided for flowing the operation fluid in the discharge circuits to the finish end of the pilot-pump fluid tubes.

SUMMARY OF THE INVENTION

A hydraulic system for a working machine, includes a hydraulic pump to output operation fluid, an output fluid tube connected to the hydraulic pump, an operation fluid tube through which the operation fluid in the output fluid tube is supplied, and being connected to a hydraulic device, an unload valve connected to the output fluid tube, and having: a supply position in which the operation fluid in the output fluid tube is supplied to the operation fluid tube; and a restrain position in which supply of the operation fluid to the operation fluid tube is restrained, an operation valve to change operation of the hydraulic device through the operation fluid, and being connected to the output fluid tube, a control fluid tube connecting the operation valve and the hydraulic device, a warmup fluid tube connecting the control fluid tube and the operation fluid tube, and a check valve provided in the warm-up fluid tube and being for allowing the operation fluid to flow from the control fluid tube side toward the operation fluid tube, and for blocking the operation fluid from flowing side from the operation fluid tube toward the control fluid tube.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
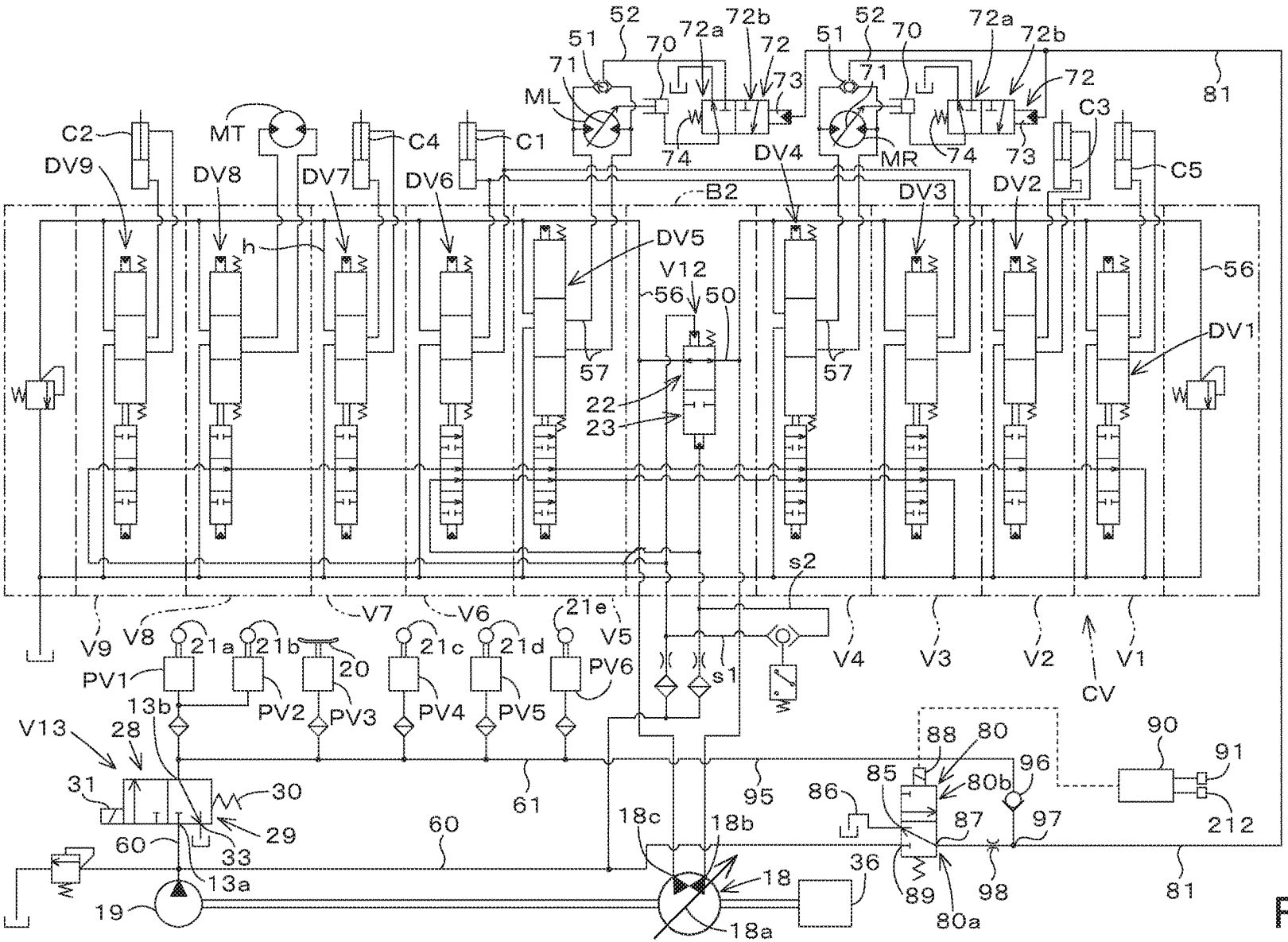
FIG. 1 is an overall view of a hydraulic system for a work machine.

The embodiments will now be described with reference to the accompanying drawings, wherein like reference numerals designate corresponding or identical elements throughout the various drawings. The drawings are to be viewed in an orientation in which the reference numerals are viewed correctly.

In the following, with reference to the drawings, an explanation of modes of embodying the present invention will be made.

A mode of embodying a hydraulic system for a work machine 1 involving the present invention will be described while referring to the appropriate figures.

Figure 3:
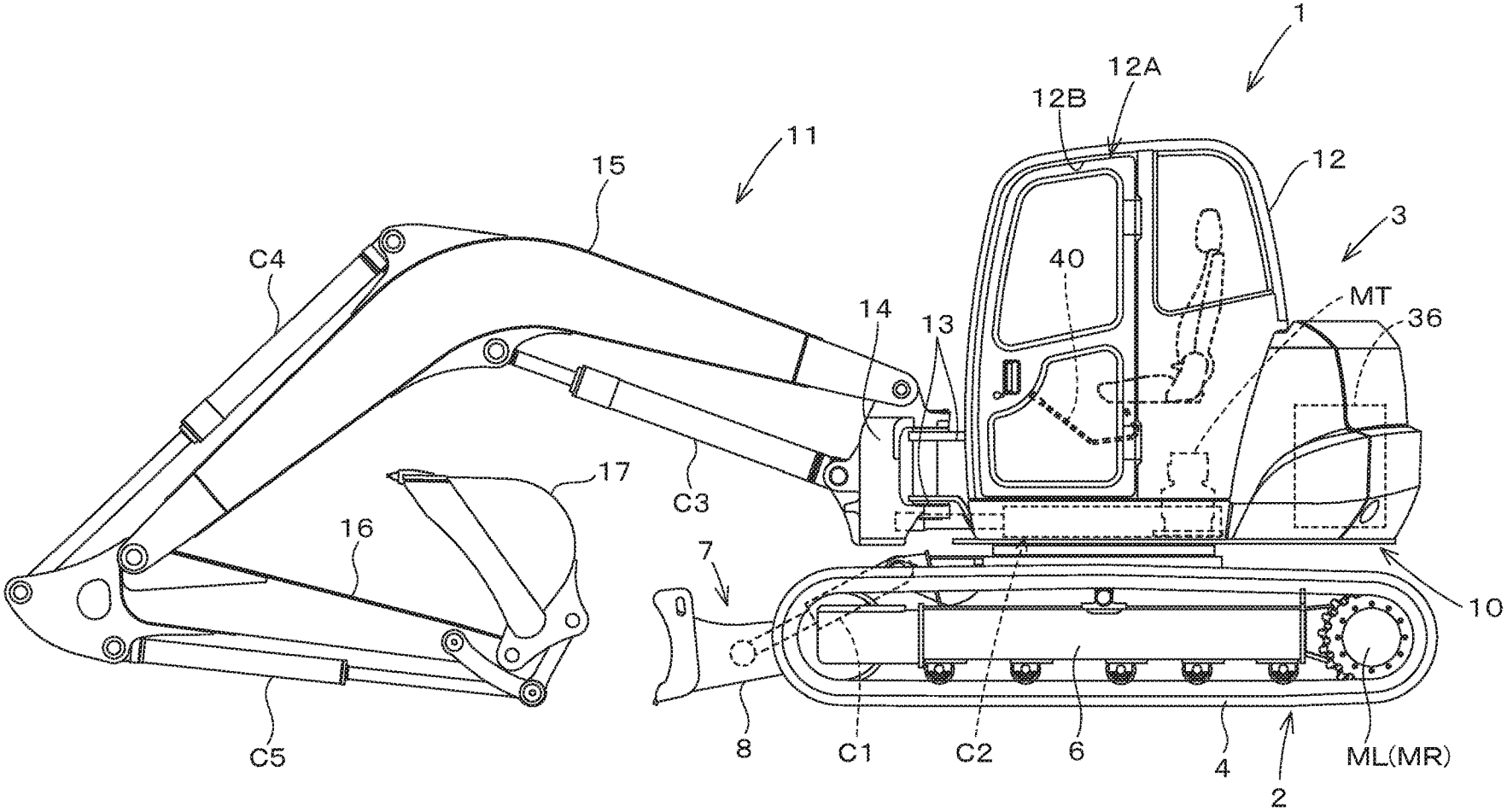
FIG. 3 is a lateral-side view of a backhoe in its entirety.

FIG. 3 represents a lateral-side view of the work machine 1 involving the present invention. In FIG. 1, a backhoe is illustrated as an example of the work machine 1. Not limited to being a backhoe, the work machine 1 may be a compact-track loader, a skid-steer loader, or the like.

As indicated in FIG. 1, the backhoe 1 is furnished with running gear 2, and an upper swiveling house 3 carried atop the running gear.

Being running gear of the crawler type, the running gear 2 is constituted by crawler belts 4 of endless band form, wrapped around track frames 6. The crawler belts 4 are rotated along the peripheries by traveling motors ML and MR.

On the front portion of the track frames 6, support arms 8 for a dozer blade 7 are provided free to swing by being pivotally supported on the frames 6. The support arms 8 are raise-/lower-driven by the extension contraction of dozer cylinders C1 constituted by hydraulic cylinders.

The swiveling house 3 has: a swivel platform 10 carried atop the track fames 6 free to turn around an up-down oriented swivel-shaft center; a front work attachment 11 that the front portion of the swivel platform 10 is rigged out with; and a cab 12 carried atop the swivel platform 10.

Provided on the swivel platform 10 are, among other components, an engine 36, a radiator, a fuel tank, a hydraulic-fluid tank, and a battery, with the swivel platform 10 being swiveled by a swivel motor MT consisting of a hydraulic motor.

On the front portion of the swivel platform 10, a support bracket 13 is provided, and on the support bracket 13, a swing bracket 14 is supported free to swing about an up-down oriented axial center. The swing bracket 14 is swung by a swing cylinder C2 consisting of a hydraulic cylinder.

The front work attachment 11 includes: a boom 15 whose basal end is pivotally supported free to turn on the upper portion of the swing bracket 14; an arm 16 pivotally supported free to turn on the apical end of the boom 15; and a bucket 17 (work tool) pivotally supported on the apical end of the arm 16.

The boom 15 is swung by means of a boom cylinder C3 interposed between the boom 15 and the swing bracket 14. The arm 16 is swung by means of an arm cylinder C4 interposed between the arm 16 and the boom 15. The bucket 17 is swung by means of a bucket cylinder C5 (working-tool cylinder) interposed between the bucket 17 in the arm 16.

The boom cylinder C3, the arm cylinder C4, and the bucket cylinder C5 are constituted by hydraulic cylinders.

Inside the cab 12, a driver's seat is provided. Further, at the front portion of the left lateral side of the cab 12, a mount/dismount entrance 12B that a mount/dismount door 12A opens/closes is provided, and at the left-hand side of the driver's seat, an unload lever 40 disposed cutting across the mount/dismount entrance 12B is provided, enabled for being pulled up.

By an operator pulling up the unload lever 40 when alighting from the vehicle, the lever's position can be changed to a location where it doesn't interfere with mounting/dismounting, and meanwhile actuation of the hydraulic actuators (the traveling motors ML and MR, the swivel motor MT, the dozer cylinders C1, the swing cylinder C2, the boom cylinder C3, the arm cylinder C4, and the bucket cylinder C5) that the backhoe 1 is equipped with can be deactivated.

FIG. 1 illustrates a work-machine hydraulic circuit (hydraulic system).

The work-machine hydraulic system is furnished with a hydraulic control device CV, a first hydraulic pump 18, and a second hydraulic pump 19. The first hydraulic pump 18 and the second hydraulic pump 19 are driven by means of the engine 36, etc. (drive source) carried by the swiveling platform 10.

The first hydraulic pump 18 is a variable-displacement-type hydraulic pump furnished with a swashplate 18*a* and associated components of a pump-volume control mechanism. In the present embodying mode, the first hydraulic pump 18 is configured by a variable displacement axial pump of swashplate form, having even flow-rate double pump functionality for discharging equal amounts of operation fluid through two independently-rendered discharge ports 18*b* and 18*c*.

To be more specific: for the first hydraulic pump 18, a split-flow-type hydraulic pump is adopted, having a mechanism for expelling operation fluid from a single piston-cylinder barrel kit alternately to discharge grooves formed in the interior/exterior of a valve plate. It should be understood that the main pump may be configured by one or a plurality of single-flow-type hydraulic pumps.

The second hydraulic pump 19 is a fixed-volume pump, and, driven by the engine 36, discharges prescribed operation fluid.

The hydraulic control device CV has: a bucket control valve V1 for controlling the bucket cylinder C5; a boom control valve V2 for controlling the boom cylinder C3; a first dozer-control valve V3 for controlling the dozer cylinder C1; a right-directed traction control valve V4 for controlling the traveling motor MR in the running gear 2 on the right side; a left-directed traction control valve V5 for controlling the traveling motor ML in the running gear 2 on the left side; a second dozer-control valve V6 for controlling the dozer cylinder C1; an arm control valve V7 for controlling the arm cylinder C4; a swivel control valve V8 for controlling the swivel motor MT; and a swing control valve V9 for controlling the swing cylinder C2.

The control valves V1 through V9 have direction-switching valves DV1 through DV9. The direction-switching valves DV1 through DV9 are switching valves of sliding-spool form. Also, the direction-switching valves DV1 through DV9 are capable of being switched by being supplied with a pilot fluid as the operation fluid.

Specifically, in proportion to the amount by which remote control valves (actuator valves) PV1 through PV6 are actuated, the spools in the direction-switching valves DV1 through DV9 are caused to move, supplying, in an amount proportional to the amount by which the spools have been moved, operation fluid to the control-target hydraulic actuators (the traveling motors ML and MR, the swivel motor MT, the dozer cylinders C1, the swing cylinder C2, the boom cylinder C3, the arm cylinder C4, and the bucket cylinder C5).

The remote control valves PV1 through PV6 are connected to a pilot fluid tube 61, wherein they are supplied with pilot fluid via the pilot fluid tube 61. The remote control valves PV1 through PV6 output pilot pressure proportioned to the actuation amount from a secondary-side port (output port) and send it toward pilot receive-pressure sections of the direction-switching valves DV1 through DV8 that are the actuation targets.

The remote control valves PV1 through PV6 include: a left-traction remote control valve PV1 for actuating the direction-switching valve DV5 for the left-directed traction control valve V5; a right-traction remote control valve PV2 for actuating the direction-switching valve DV4 for the right-directed traction control valve V4; a swing remote control valve PV3 for actuating the direction-switching valve DV9 for the swing-control valve V9; a dozer remote control valve PV4 for actuating the direction-switching valve DV3 for the first dozer-control valve V3, and the direction-switching valve DV6 for the second dozer-control valve V6; a swivel/arm remote control valve PV5 for actuating the direction-switching valve DV8 for the swivel-control valve V8, and the direction-switching valve DV7 for the arm control valve V7; and a bucket/boom remote control valve PV6 for actuating the direction-switching valve DV1 for the bucket control valve V1, and the direction-switching valve DV2 for the boom control valve V2.

The swing remote control valve PV3 is actuated by an actuation pedal 20, and the other remote control valves PV1, 2, and 4 through 6 are actuated by actuation levers 21*a* through 21*e* (actuation components) any of which are actuatable from the position where the operator is seated in the driver's seat.

Also, the direction-switching valve DV3 for the first dozer-control valve V3, and the direction-switching valve DV6 for the second dozer-control valve V6 are simultaneously actuated by the single dozer remote control valve V4 (they operate simultaneously).

The actuation levers 21*a* and 21*b* (traction-actuation components) for actuating the left-traction remote control valve PV1 and the right-traction remote control valve PV2 are front-rear manipulated from a neutral position, wherein throwing the actuation levers 21*a* and 21*b* frontward forward-drives the actuation-target running gear 2, and throwing them rearward backward-drives the actuation-target running gear 2.

The actuation levers 21*d* and 21*e* for actuating the swivel/arm remote control valve PV5 and the bucket/boom remote control valve PV6 are rendered bidirectionally actuatable in the front-to-back orientation and the left-to-right (along the machine-body width) orientation (the levers are rendered to be frontward/backward and leftward/rightward actuatable from the neutral position).

Manipulation of the actuation lever 21*d* for the swivel/arm remote control valve PV5 along one direction (e.g., leftward/rightward) actuates the direction-switching valve DV8 for the swivel-control valve V8, and manipulation of the lever along the other direction (e.g., frontward/backward) actuates the direction-switching valve DV7 for the arm-control valve V7.

Likewise, manipulation of the actuation lever 21*e* (boom actuation component) for the bucket/boom remote control valve PV6 along one direction (e.g., leftward/rightward)

actuates the direction-switching valve DV1 for the bucket-control valve V1, and manipulation of the lever along the other direction (e.g., frontward/backward) actuates the direction-switching valve DV2 for the boom-control valve V2.

It will be appreciated that complex combined operations can be performed by tilt-moving the actuation levers 21*d* and 21*e* for the remote control valves PV5 and PV6 along included directions between frontward/backward and leftward/rightward.

Herein, the work-machine hydraulic system is furnished with a traction-independence valve V12. The traction-independence valve V12 is configured from a sliding-spool-type switching valve and at the same time is also configured by a pilot-switching valve that is switching-actuated by pilot pressure.

The traction-independence valve V12 is rendered to allow it to switch between a merge position 22 that permits flow-through of operation fluid from a coupling tube 50, and an independent-supply position 23 that shuts off flow-through of operation fluid from the coupling tube 50, wherein the valve is energized by a spring in the direction in which it is switched into the merge position 22.

When the traction-independence valve V12 is in the merge position 22, discharge fluid from the first discharge port 18*b* and discharge fluid from the second discharge port 18*c* merge and are supplied to the direction-switching valves DV1 through 9.

Likewise, when the traction-independence valve V12 is switched into the independent-supply position 23, discharge fluid from the first discharge port 18*b* is supplied to the right-directed traction-control valve V4 and to the direction-switching valves DV4 and DV3 for the first dozer-control valve V3, and at the same time, operation fluid out of the second discharge port 18*c* is supplied to the leftward-directed traction-control valve V5 and to the traveling switching valves DV5 and DV6 for the second dozer-control valve V6.

As indicated in FIG. 1, a output fluid tube 60 is connected to the second hydraulic pump 19. Also, an unload valve V13 is connected to the output fluid tube 60, and a pilot-fluid tube 61 is connected to the unload valve V13.

That is, the output fluid tube 60 is connected to a primary-side port (primary port) 13*a* on the unload valve V13, and the pilot-fluid tube 61 is connected to a secondary-side port (secondary port) 13*b* on the unload valve V13.

The unload valve V13 is a dual-position switching valve capable of switching between a supply position 28 and a restrain position 29. When it is in the supply position 28, the unload valve V13 supplies operation fluid from the output fluid tube 60 to the pilot-fluid tube 61.

When it is in the restrain position 29, the unload valve V13 holds supply of the operation fluid toward the pilot-fluid tube 61 in check, that is, the valve halts the supplying of operation fluid from the output fluid tube 60 to the pilot-fluid tube 61.

The unload valve V13 is energized by a spring 30 in the direction in which the valve is switched into the restrain position (unload position) 29, wherein it is put into the restrain position 29 by a solenoid 31 being demagnetized and is switched into the supply position 28 by the solenoid 31 being magnetized.

The solenoid 31 for the unload valve V13 is magnetized in a position where the unload lever 40, disposed on the left-hand side of the driver's seat, has been lowered, and is demagnetized by the unload lever 40 being pulled up.

Accordingly, lowering the unload lever 40 switches the unload valve V13 into the supply position 28, sending the operation fluid (discharge fluid) from the second hydraulic pump 19 to the pilot-fluid tube 61 via the unload valve V13, and supplying it from the pilot-fluid tube 61 to the primary-side ports on the remote control valves PV1 through PV6.

Pulling up the unload lever 40 switches the unload valve V13 into the restrain position 29, whereby operation fluid (pilot fluid) is kept from being supplied to the remote control valves PV1 through PV6 and actuation of the hydraulic actuators ML, MR, MT, and C1 through C5 becomes impossible.

Now, while on one hand the work-machine hydraulic system carries out operation of the hydraulic devices (second hydraulic devices) carried on the work machine, in situations where warmup of the operation fluid is necessary, carrying out hydraulic-fluid warmup is possible. The second hydraulic devices are hydraulic devices differing from later-described first operation devices, and are hydraulic devices whose operations are varied by operation valves.

In the present embodying mode, the second hydraulic devices are running-series hydraulic devices. For convenience of explanation, the running-fluid series hydraulic devices will be referred to as running hydraulic devices.

To begin with, the running hydraulic devices and the operation valves will be described.

The running hydraulic devices include the traveling motors ML and MR, regulators 70, and speed-switching valves 72. The traveling motors ML and MR are motors that are operated by operation fluid supplied from the direction-switching valves DV4 and DV5, and their rpm (rotational speed) can be changed just by the angle of swashplates 71 (swashplate angle).

The regulators 70 switch the rotational speed of the traveling motors ML and MR by changing the swashplate angle of the traveling motors ML and MR. The regulators 70 are connected to the speed-switching valves 72 via fluid tubes 52.

High-pressure selector valves 51 are connected to the fluid tubes 52, wherein the operation fluid output from the direction-switching valve DV5 is supplied to the speed-switching valves 72 via the high-pressure selector valves 51 and the fluid tubes 52.

The speed-switching valves 72 are dual-position switching valves, and are enabled to switch between a first position 72*a* and a second position 72*b*. When the speed-switching valves 72 are in the first position 72*a*, the regulators 70 operate, whereby the swashplate angle is set to a predetermined angle for the low-speed side (low-speed angle).

That is, the speed-switching valves 72 being in the first position 72*a* put the rotational speed of the traveling motors ML and MR at the low-speed side rpm. On the other hand, the speed switching valves 72 being in the second position 72*b* run the regulators 70, whereby the swashplate angle is set to a predetermined angle for the high-speed side (high-speed angle).

Thus, the speed-switching valves 72 being in the second position 72*b* put the rotational speed of the traveling motors ML and MR at the high-speed side rpm.

The switching over of the speed-switching valves 72 is carried out by the operation fluid (pilot fluid) acting on receive-pressure sections 73. When the pilot pressure of the pilot fluid is not acting on receive-pressure sections 73 (when the pilot pressure acting on the receive-pressure sections 73 is less than a predetermined pressure), the speed-switching valves 72 are retained in the first position 72*a* by springs 74.

Further, when the pilot pressure of the pilot fluid acts on the receive-pressure sections 73 (when the pilot pressure acting on the receive-pressure sections 73 is a predetermined pressure or greater), the speed-switching valves 72 are retained in the second position 72*b*.

The switching over of the pilot pressure on the speed-switching valves 72 is carried out by a traveling switching valve 80 connected to the running hydraulic devices (the traveling motors ML and MR, the regulators 70, and the speed-switching valves 72). The traveling switching valve 80 is one of operation valves enabled for changing the operation of the running hydraulic devices, and is connected to the speed-switching valves 72 via a control fluid tube 81.

Further, the traveling switching valve 80 is connected to the output fluid tube 60, wherein it is supplied with operation fluid (pilot fluid) from the output fluid tube 60.

The traveling switching valve 80 is a dual-position switching valve, and is enabled to switch between a first position 80*a* and a second position 80*b*. In instances where the traveling switching valve 80 is in the first position 80*a*, the pilot fluid in the control fluid tube 81 is discharged from a discharge port 85 into a output fluid tube 86; consequently no pilot pressure acts on the receive-pressure sections 73 of the speed-switching valves 72.

That is, when the traveling switching valve 80 is in the first position 80*a*, flowing of pilot fluid into the control fluid tube 81 is held in check.

Further, when the traveling switching valve 80 is in the second position 80*b*, the pressure of pilot fluid in the control fluid tube 81 is boosted by operation fluid from an output port 87 (pilot pressure acts on the control fluid tube 81), wherein the pilot pressure in the receive-pressure sections 73 of the speed-switching valves 72 goes to or above a predetermined level. That is, when in the second position 80*b*, the traveling switching valve 80 causes the pilot fluid to flow into the control fluid tube 81.

Thus as in the foregoing, when in the first position 80*a*, the traveling switching valve 80 switches the rotational speed of the traveling motors ML and MR to the low-speed side, and when in the second position 80*b*, it switches the rotational speed of the traveling motors ML and MR to the high-speed side.

Switching of the traveling switching valve 80 between the first position 80*a* and the second position 80*b* is carried out by demagnetizing, magnetizing, etc. a solenoid 88. Specifically, a control device 90 is connected to the traveling switching valve 80, and an actuation component 91 that is actuatable in at least two positions is connected to the control device 90.

The actuation component 91 is, for example, a switch that switches to on/off, wherein when the switch is off, the control device 90 demagnetizes the solenoid 88 for the traveling switching valve 80, and when the switch is on, the control device 90 magnetizes the solenoid 88 for the traveling switching valve 80.

In the solenoid 88 demagnetized state of the traveling switching valve 80, it is switched into the first position 80*a*, and in the magnetized state, it is switched into the second position 80*b*.

In accordance with the foregoing, the operation of the running hydraulic devices (the traveling motors ML and MR, the regulators 70, the speed switching valves 72) can be changed by switching over an operation valve (the traveling switching valve 80).

Next, warmup of the operation fluid will be described.

Warmup of the work-machine hydraulic system can be carried out by switching between the unload valve V13 and the operation valve (traveling switching valve 80). As indicated in FIG. 1, a warmup fluid tube 95 for carrying out warmup is connected to the control fluid tube 81 to which the traveling switching valve 80 is connected.

Further, the warmup fluid tube 95 is also connected to a secondary-side fluid tube (operation fluid tube) to the unload valve V13. Herein, the "operation fluid tube" is a fluid tube that first hydraulic devices operated by operation fluid having passed through the unload valve V13 are connected to.

In this embodying mode, the operation fluid tube is the pilot fluid tube 61, and the first hydraulic devices are the remote control valves PV1 through PV6.

It should be understood that although the first hydraulic devices are the remote control valves PV1 through PV6, they may be any device that is operated by operation fluid having passed through the unload valve V13, and may be the control valves V1 through V9, or may be the above-described traveling motors ML and MR.

In instances where the control valves V1 through V9 are the first hydraulic devices, the operation fluid tube will be a fluid tube 56 that connects the first hydraulic pump 18 with the control valves V1 through V9, with the unload valve V13 being connected to the fluid tube 56.

And in instances where the first hydraulic devices are the traveling motors ML and MR, the operation fluid tube will be a fluid tube 57 that connects the direction-switching valves DV4 and DV5 with the traveling motors ML and MR. In that case, the traveling motors ML and MR become hydraulic devices acting both as first hydraulic devices and as second hydraulic devices.

One end of the warmup fluid tube 95 is connected to the pilot fluid tube 61, and the other end of the warmup fluid tube 95 is connected to the control fluid tube 81.

A check valve 96 is connected to the warmup fluid tube 95. The check valve 96 is a valve that permits the flowing of operation fluid from the control fluid tube 81 into the pilot fluid tube (operation fluid tube) 61, and that blocks the flowing of operation fluid from the pilot fluid tube (operation fluid tube) 61 into the control fluid tube 81.

A choke feature 98 is provided upstream of the connection point 97 where the control fluid tube 81 and the warmup fluid tube 95 connect. In this embodying mode, the choke feature 98 is provided in the control fluid tube 81, in the interval between the output port 87 on the traveling switching valve 80 and the connection point 97.

Figure 2:
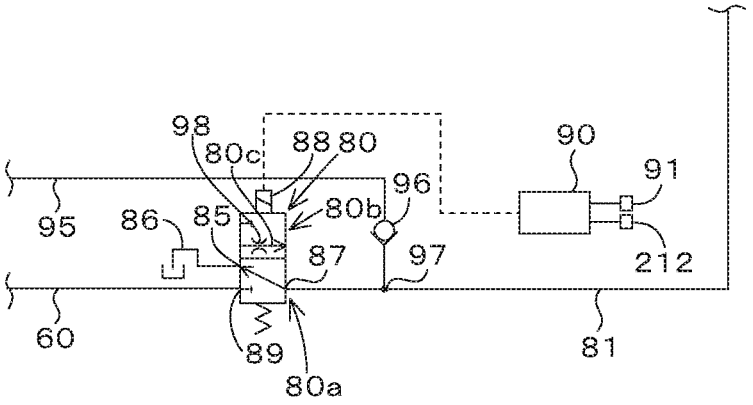
FIG. 2 is a diagram in which a choke feature is provided in an internal fluid tube in the operation valve.

It should be understood that the choke feature 98 may be provided in the output fluid tube 60, upstream of an input port 89 on the traveling switching valve 80. Further, as indicated in FIG. 2, the choke feature 98 may even be provided in the operation valve (traveling switching valve 80), in an internal fluid tube 80*c* that couples the input port 89 and the output port 87 when the valve is in the second position 80*b*.

In accordance with the foregoing, warmup can be carried out by, for example, an operator or other worker lifting the unload lever 40 to put the unload valve V13 into the restrain position 29, and then manipulating the actuation component 91 to put the traveling switching valve 80 into the second position 80*b*.

That is, in the situation where the unload valve V13 has been put into the restrain position 29 and the traveling switching valve 80 into the second position 80*b*, operation fluid having passed through the traveling switching valve 80 can enter the warmup fluid tube 95 via the control fluid tube 81, and operation fluid having passed through the check valve 96 and the warm-up fluid tube 95 can go by way of the pilot-fluid tube 61 and be discharged through a discharge port 33 on the unload valve V13.

On the other hand, in the situation where the unload valve V13 has been put into the supply position 28, the traveling switching valve 80 can be switched into either the first position 80*a* or the second position 80*b* by the actuation component 91 being switched to either on/off.

In sum, once the unload valve V13 has been put into the supply position 28, the traveling switching valve 80 can be switched over to shift the traveling motors ML and MR into either a first speed or a second speed.

It will be appreciated that in the above-described embodying mode, the unload valve V13 is switched over by raising and lowering of the unload lever 40. As an alternative to that, a switch (unloader changeover switch) that is capable of being switched on/off may be provided, and the unload valve V13 switched over by flipping the switch.

Further, a fluid-temperature detection device 212 for detecting the temperature (fluid temperature) of the pilot fluid or other operation fluid may be connected to the control device 90. In cases where the fluid temperature that the fluid-temperature detection device 212 has detected (detecting fluid temperature) is lower than a predetermined temperature (gauging fluid temperature), the control device 90 may turn the unloader changeover switch on, switching the unload valve V13 into the restrain position 29 and at the same time putting the traveling switching valve 80 into the second position 80*b*.

The work-machine hydraulic system comprises: the hydraulic pump 19 for discharging operation fluid; the output fluid tube 60 connected to the hydraulic pump 19; the operation fluid tube (pilot-fluid tube) 61 through which operation fluid in the output fluid tube 60 is supplied, and being connected to different hydraulic device from the hydraulic pump 19; the unload valve V13 enabled for switching between the supply position 28 in which operation fluid in the output fluid tube 60 is supplied to the operation fluid tube (pilot-fluid tube) 61, and the restrain position 29 in which supply of the operation fluid to the operation fluid tube (pilot-fluid tube) 61 is held in check; the operation valve (traveling switching valve) 80 connected to the output fluid tube 60, and enabled for changing operation of the hydraulic devices through the operation fluid; the control fluid tube 81 connecting the operation valve (traveling switching valve) 80 and the hydraulic devices; the warmup fluid tube 95 connected to the control fluid tube 81 and the operation fluid tube (pilot-fluid tube) 61; and the check valve 96 provided in the warmup fluid tube 95 and being for allowing the operation fluid to flow from the control-fluid-tube 81 end toward the operation fluid tube (pilot-fluid tube) 61, and for blocking the operation fluid from flowing from the operation fluid tube (pilot-fluid tube) 61 end toward the control fluid tube 81.

In accordance with this configuration, upon the unload valve V13 having been brought into the state where it is in the restrain position 29, actuating an operation valve such as the traveling switching valve 80 makes it possible to circulate to the unload valve V13, via operation fluid tubes including the control fluid tube 81 and the pilot-fluid tube 61, operation fluid having passed through that operation valve.

Further, in the state where the unload valve V13 has been brought into the supply position 28, the hydraulic devices can be operated by actuating the operation valve.

The operating valve (traveling switching valve) 80 is enabled for switching between the first position 80*a* in which operation fluid discharged from the output fluid tube 60 is restrained from being flowed into the control fluid tube 81, and a second position 80*b* in which operation fluid discharged from the output fluid tube 60 is flowed into the control fluid tube 81.

In accordance with this configuration, warmup can be carried out by putting the operation valve into the second position 80*b* and putting the unload valve V13 into the restrain position 29.

The operating valve (traveling switching valve) 80 is switchable into the second position 80*b* when the unload valve V13 is in the restrain position 29. In accordance with this configuration, switching over the operating valve enables warmup to be carried out smoothly.

When the unload valve V13 is in the supply position 28, the operating valve (traveling switching valve) 80 is switched into either of the first position 80*a* or the second position 80*b*. In accordance with this configuration, with the unload valve V13 being in the supply position 28, operation of the hydraulic devices can be varied by the operation valve.

The choke feature 98 is provided upstream of the connection point where the control fluid tube 81 and the warmup fluid tube 95 connect. In accordance with this configuration, the choke feature 98 makes it possible to adjust the flow rate of the operation fluid that will be warmed up. In other words, the choke feature 98 can restrain numerous warmed-up operation fluids at once from flowing to the unload valve V13 during warmup.

The hydraulic devices of the work-machine hydraulic system include the traveling motors ML and MR, and a regulator 70 enabled for changing the rotational speed of the traveling motors ML and MR by means of the operation fluid, and the operation valve is the traveling switching valve 80 for controlling operation fluid supplied to the regulator 70.

In accordance with this configuration, while on the one hand the traveling switching valve 80 makes it possible to change the rotational speed of the traveling motors ML and MR, the traveling switching valve 80 also makes it possible to carry out warmup.

The hydraulic devices include remote control valves for actuating the hydraulic devices, wherein the operation fluid tube is a pilot-fluid tube for supplying pilot fluid as the operation fluid to the remote control valves. This configuration makes it possible to efficiently warm up the pilot-fluid tube to which the remote control valves are connected.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

What is claimed is:

1. A hydraulic system for a working machine, comprising:

a hydraulic pump to output operation fluid into an output fluid tube;

an unload valve connected between the hydraulic pump and a pilot fluid tube, the unload valve having a supply position to flow the operation fluid from the output fluid tube to the pilot fluid tube, and a non-supply position to block the operation fluid from the output fluid tube to the pilot fluid tube, and to flow the operation fluid from the pilot fluid tube to a discharge port of the unload valve;

a first hydraulic device configured to receive the operation fluid from the pilot fluid tube when the unload valve is at the supply position;

an operation valve connected between the output fluid tube and a control fluid tube, the operation valve having a first position to block the operation fluid from the output fluid tube to the control fluid tube, and a second position to flow the operation fluid from the output fluid tube to the control fluid tube;

a second hydraulic device configured to receive the operation fluid from the control fluid tube when the operation valve is at the second position;

a warm-up fluid tube connected between the pilot fluid tube and the control fluid tube; and a check valve provided in the warm-up fluid tube and configured to flow the operation fluid from the control fluid tube to the pilot fluid tube, and to block the operation fluid from flowing from the pilot fluid tube to the control fluid tube, wherein when the unload valve is at the non-supply position and the operation valve is at the second position, the operation fluid output from the hydraulic pump flows through the output fluid tube, the operation valve, the control fluid tube, the check valve, the warm-up fluid tube and the pilot fluid tube to the discharge port of the unload valve.

2. The hydraulic system according to claim 1, wherein when the unload valve is at the non-supply position and the operation valve is at the second position, the operation fluid is circulated among the hydraulic pump, the output fluid tube, the operation valve, the control fluid tube, the check valve, the warm-up fluid tube, the pilot fluid tube, and the discharge port of the unload valve to warm up the operation fluid.

3. The hydraulic system according to claim 1, comprising:

a throttle provided upstream of an interconnection point between the control fluid tube and the warm-up fluid tube.

4. The hydraulic system according to claim 1, wherein the operation valve has a throttle provided in an internal fluid tube that is coupled between an input port and an output port of the operation valve when the operation valve is at the second position.

5. The hydraulic system according to claim 1, wherein the first hydraulic device includes a remote control valve, and wherein the remote control valve is configured to receive the operation fluid from the pilot fluid tube to operate a hydraulic actuator, when the unload valve is at the supply position.

6. The hydraulic system according to claim 1, wherein the second hydraulic device includes a speed-switching valve to control the operation fluid to be supplied to a regulator that regulates a rotational speed of a traveling motor.

* * * * *